US011337500B2

(12) United States Patent
Rupprecht

(10) Patent No.: US 11,337,500 B2
(45) Date of Patent: May 24, 2022

(54) MOUNTING

(71) Applicant: Hilti Aktiengesellschaft, Schaan (LI)

(72) Inventor: Hans Rupprecht, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 398 days.

(21) Appl. No.: 16/347,803

(22) PCT Filed: Nov. 2, 2017

(86) PCT No.: PCT/EP2017/078005
§ 371 (c)(1),
(2) Date: May 6, 2019

(87) PCT Pub. No.: WO2018/083146
PCT Pub. Date: May 11, 2018

(65) Prior Publication Data

US 2019/0289971 A1 Sep. 26, 2019

(30) Foreign Application Priority Data

Nov. 7, 2016 (EP) ..... 16197494

(51) Int. Cl.
*A45C 7/00* (2006.01)
*A45F 5/00* (2006.01)
(Continued)

(52) U.S. Cl.
CPC ..... *A45C 7/0045* (2013.01); *A45F 5/00* (2013.01); *A45C 5/14* (2013.01); *A45C 13/005* (2013.01);
(Continued)

(58) Field of Classification Search
CPC ..... A45C 7/0045; B60S 1/4003
See application file for complete search history.

(56) References Cited

U.S. PATENT DOCUMENTS 2,372,845 A * 4/1945 Nelson ..... A45C 5/00 190/108
4,892,192 A 1/1990 Hague, Sr. et al.
(Continued)

FOREIGN PATENT DOCUMENTS

CN 1213349 A 4/1999
CN 2634026 Y 8/2004
(Continued)

OTHER PUBLICATIONS

International Search Report of PCT/EP2017/077885, dated Jan. 16, 2018.

*Primary Examiner* — John K Fristoe, Jr.
*Assistant Examiner* — Justin Caudill
(74) *Attorney, Agent, or Firm* — Davidson, Davidson & Kappel, LLC

(57) ABSTRACT

A device for retaining at least one container, in particular a case, on a transport unit, including a retaining bracket for insertion into a recess of the container, whereby the container is retained by the retaining bracket and is fastened on the transport unit, the retaining bracket including a first and second bearing pin; and a first bearing element for accommodating the first bearing pin and a second bearing element for accommodating the second bearing pin, the first and second bearing pins being rotatable in the particular bearing element around a shared axis. The retaining bracket is insertable into the recess of the container. The first and second bearing elements each include a recess, so that the first and second bearing pins are removable from the particular bearing element when the retaining bracket is located in a removal position.

16 Claims, 11 Drawing Sheets

(51) Int. Cl.
*A45C 5/14* (2006.01)
*A45C 13/00* (2006.01)
*A45C 13/30* (2006.01)

(52) U.S. Cl.
CPC ..... *A45C 2013/306* (2013.01); *A45F 2200/05* (2013.01)

(56) References Cited

U.S. PATENT DOCUMENTS

| | | | | |
|---|---|---|---|---|
| 5,979,023 | A | 11/1999 | Nutto | |
| 6,022,638 | A * | 2/2000 | Horton | H01M 50/256 429/187 |
| 7,503,569 | B2 * | 3/2009 | Duvigneau | A45C 7/0045 190/110 |
| 2006/0027475 | A1 * | 2/2006 | Gleason | B25H 3/021 206/373 |
| 2007/0012694 | A1 | 1/2007 | Duvigneau | |
| 2011/0168599 | A1 * | 7/2011 | Koenig | A45C 7/0045 206/509 |

FOREIGN PATENT DOCUMENTS

| | | | |
|---|---|---|---|
| CN | 203607996 | U | 5/2014 |
| CN | 104519778 | A | 4/2015 |
| DE | 3218330 | | 9/1983 |
| GB | 2445216 | A | 7/2007 |
| JP | S6354322 | U | 4/1988 |
| JP | H07215344 | | 8/1995 |

* cited by examiner

MOUNTING

The present invention relates to a device for retaining at least one container, in particular a case, on a transport unit, containing a retaining bracket to be inserted into a recess of the container, whereby the container is retained by the retaining bracket and fastened on the transport unit, the retaining bracket containing a first and second bearing pin and a first bearing element for receiving the first bearing pin and a second bearing element for receiving the second bearing pin, the first and second bearing pins being rotatable in the particular bearing element about a shared axis, the retaining bracket is positionable reversibly in a first and second plane, the first plane extending essentially horizontally and the second plane extending essentially vertically, and the retaining bracket being insertable into the recess of the container when the retaining bracket is located in the second plane.

BACKGROUND

The transport of containers including tools, in particular cases, from or to construction sites frequently represents a large problem. The containers are often heavy and/or bulky, so that carrying the container over a longer distance and period of time is almost impossible. Transport units, for example, mobile water treatment devices, may be used to convey heavy and bulky tool containers. The devices according to the prior art for fastening the container on the transport unit, for example, water treatment devices, however, are often impractical, since they may be easily damaged if they are used improperly. In particular, if the container is not removed properly from the retaining device, the retaining device may deform or break.

SUMMARY OF THE INVENTION

It is an object of the present invention to provide a device for retaining at least one container, in particular a case, on a transport unit, using which damage to the retaining device in the event of improper handling may be easily prevented.

The present invention provides a device for retaining at least one container, in particular a case, on a transport unit, containing a retaining bracket to be inserted into a recess of the container, whereby the container is retained by the retaining bracket and fastened on the transport unit, the retaining bracket including a first and second bearing pin and a first bearing element for receiving the first bearing pin and a second bearing element for receiving the second bearing pin, the first and second bearing pins being rotatable in the particular bearing element about a shared axis, the retaining bracket is positionable reversibly in a first and second plane, the first plane extending essentially horizontally and the second plane extending essentially vertically, and the retaining bracket being insertable into the recess of the container when the retaining bracket is located in the second plane.

According to the present invention, it is provided for the water supply device that the first and second bearing elements each include a recess, so that the first and second bearing pins are removable from the particular bearing element when the retaining bracket is located in a removal position.

According to one advantageous specific embodiment of the present invention, it may be provided that the first and second bearing elements each include an elastic component, whereby the width of the recess is changeable on the particular bearing element.

According to another advantageous specific embodiment, it may be provided that a positioning unit is included for securing the retaining bracket in the first or second plane.

According to one advantageous embodiment of the present invention, it may be provided that the positioning unit includes at least one notch and a protrusion corresponding to the notch.

Further advantages result from the following description of the figures. Various exemplary embodiments of the present invention are shown in the figures. The figures, the description, and the claims contain numerous features in combination. A person skilled in the art will also advantageously consider the features individually and combine them to form reasonable further combinations.

BRIEF DESCRIPTION OF THE DRAWINGS

In the figures, identical and equivalent components are identified by identical reference numerals.

DETAILED DESCRIPTION

Figure 1:
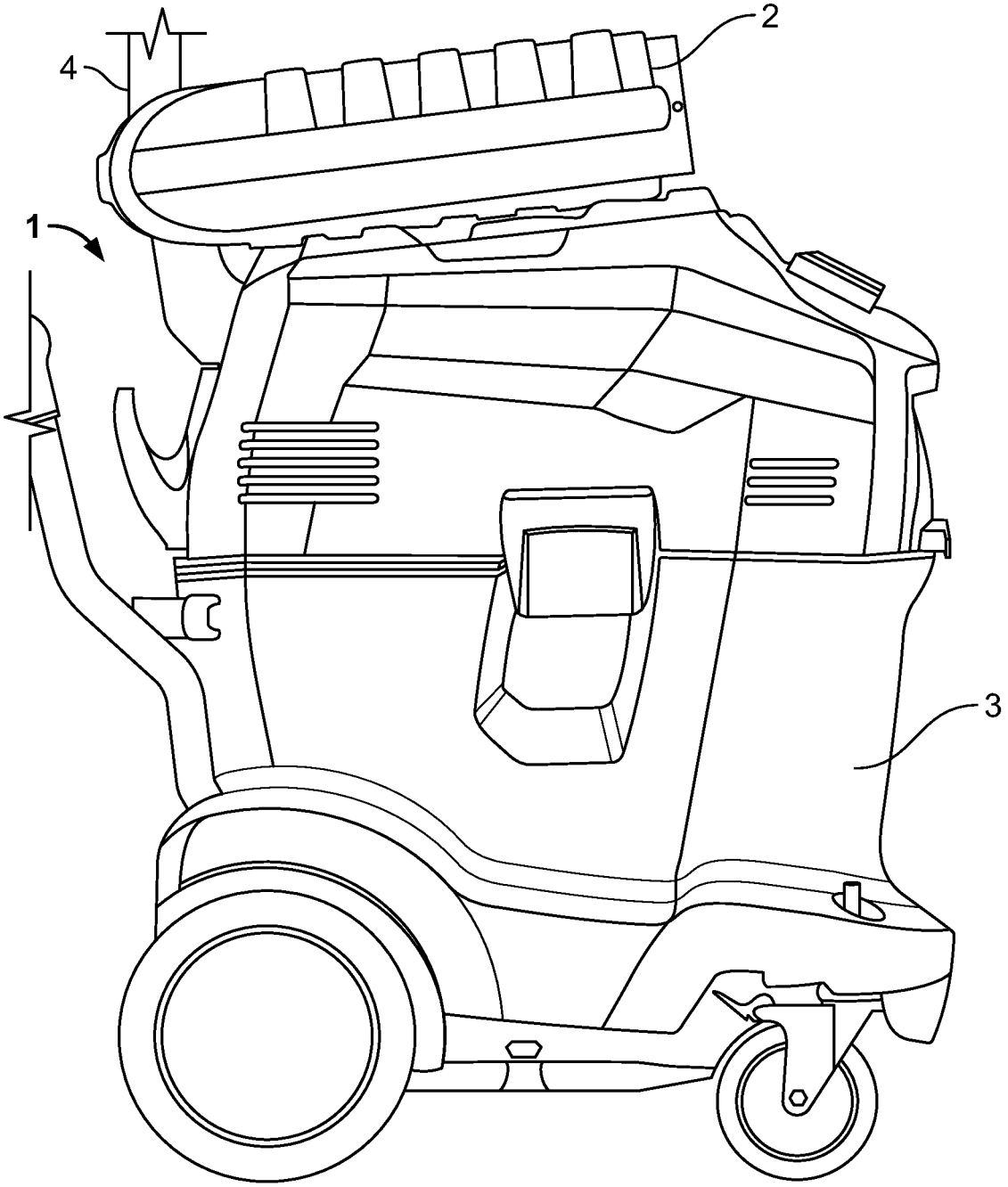
FIG. 1 shows a side view of a transport unit designed as a water treatment device including a device according to the present invention for retaining a container designed as a case.
Figure 2:
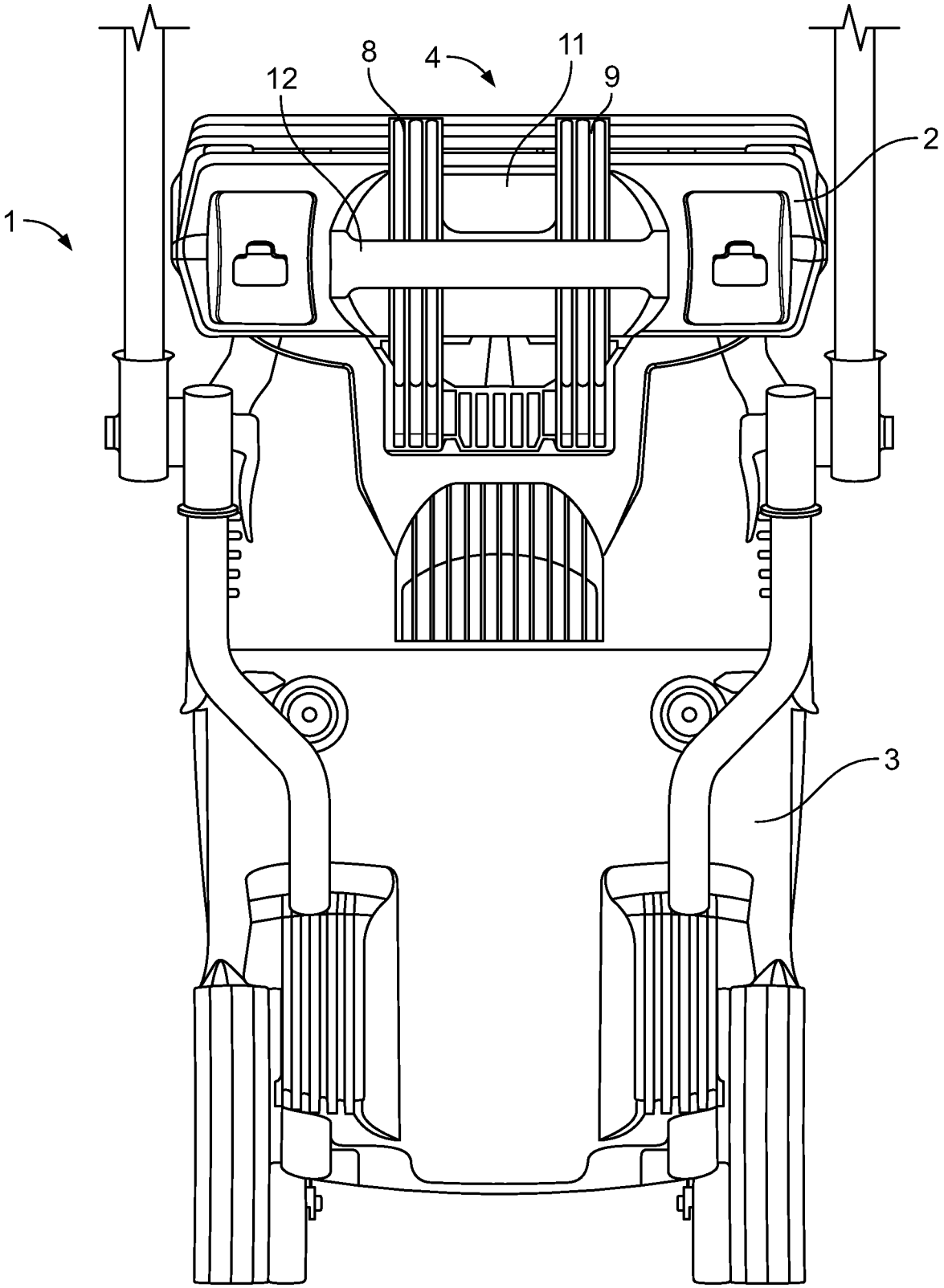
FIG. 2 shows a rear view of the transport unit including the device according to the present invention for retaining the container.
Figure 3:
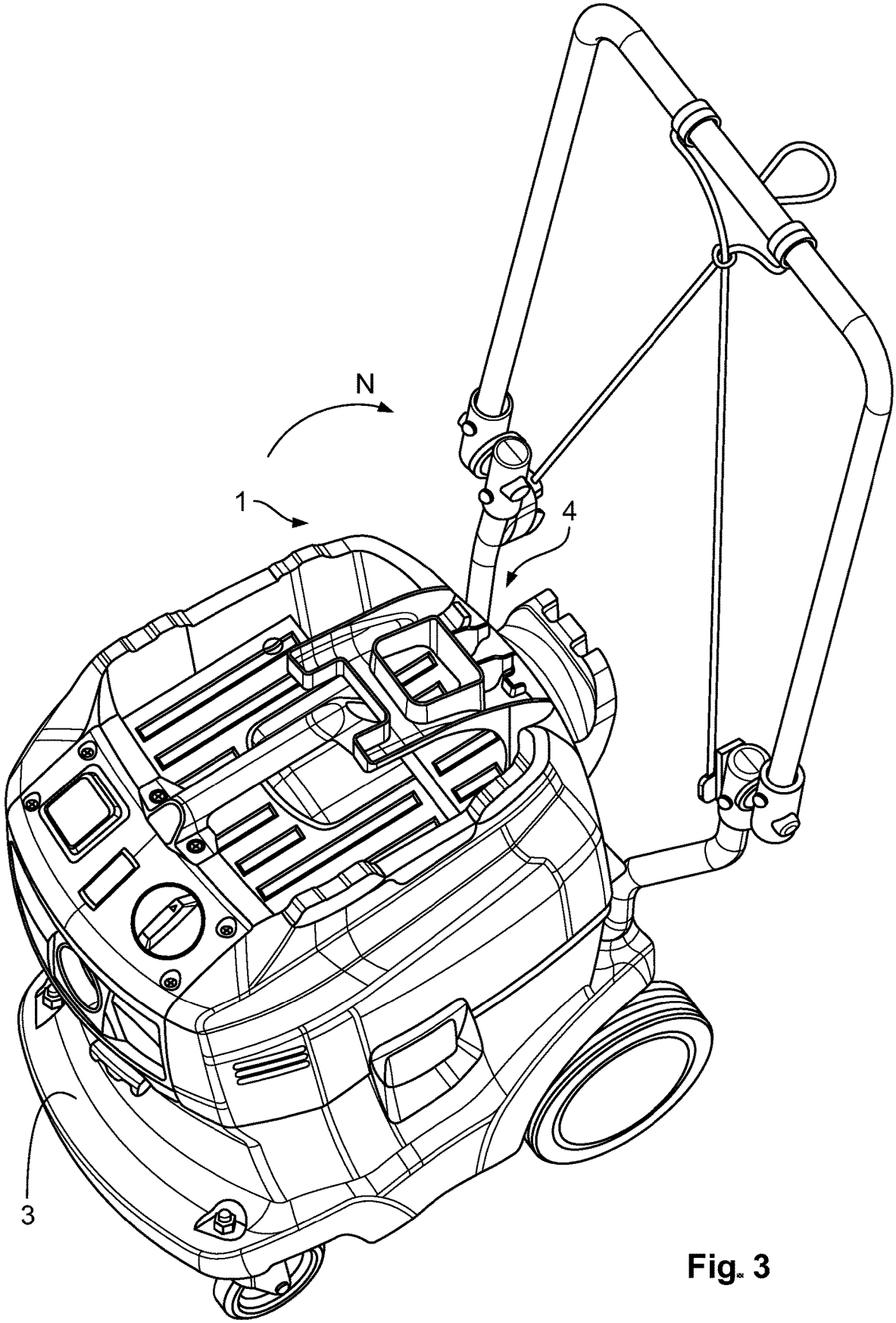
FIG. 3 shows a perspective view of the transport unit including the device according to the present invention for retaining the container, a retaining bracket being located in the first plane.

FIGS. 1, 2, and 3 show a device 1 for retaining at least one container 2, in particular a case, on a transport unit 3. Transport unit 3 is a water treatment device, which is used to supply a power tool, for example, a core drill, with water for flushing and cooling. The case is used in particular for accommodating a power tool, for example, a drill hammer or a grinding machine.

Device 1 essentially includes a retaining bracket 4, a first bearing element 5, and a second bearing element 6.

Figure 7:
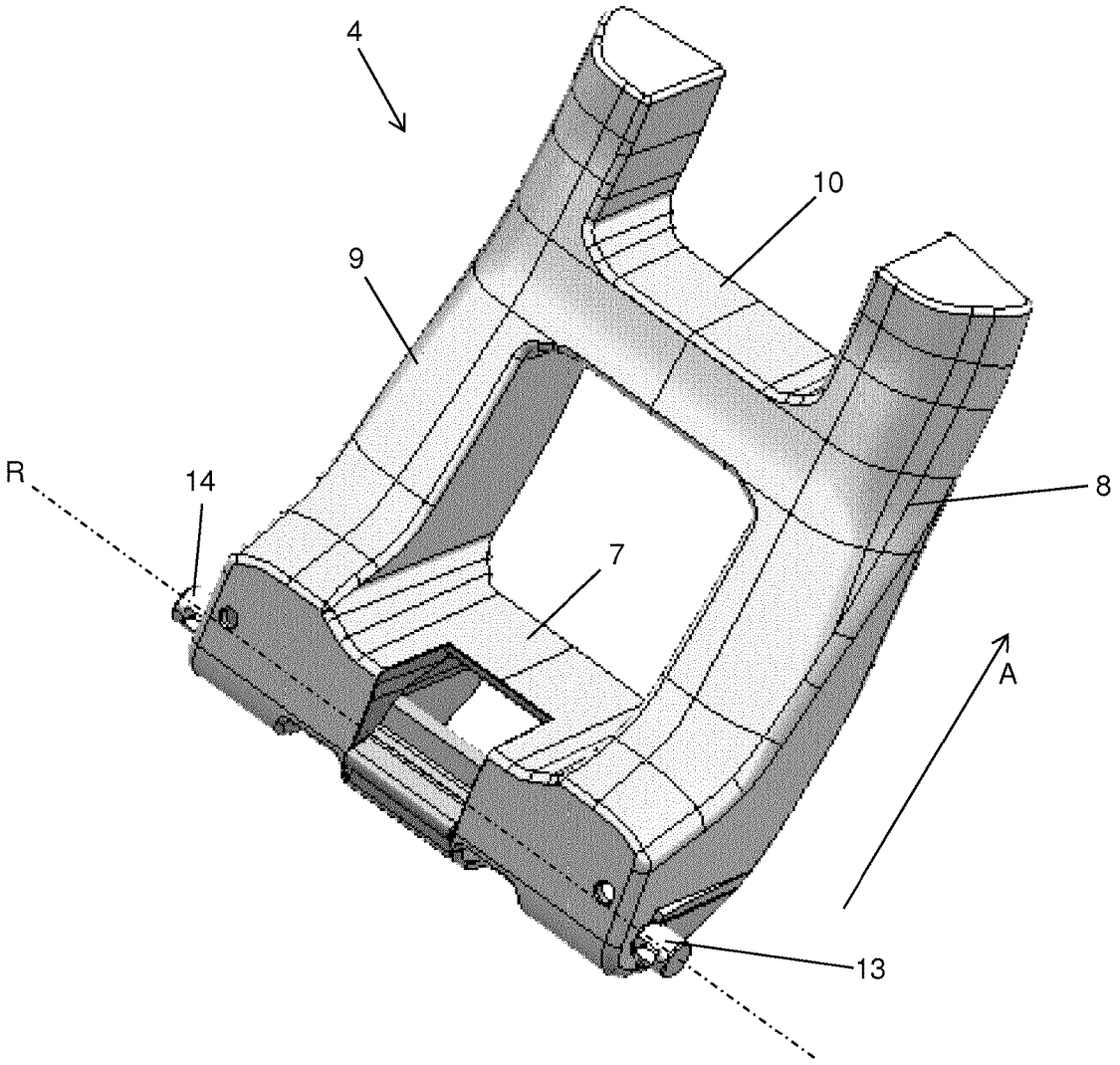
FIG. 7 shows a perspective view of the retaining bracket.
Figure 8:
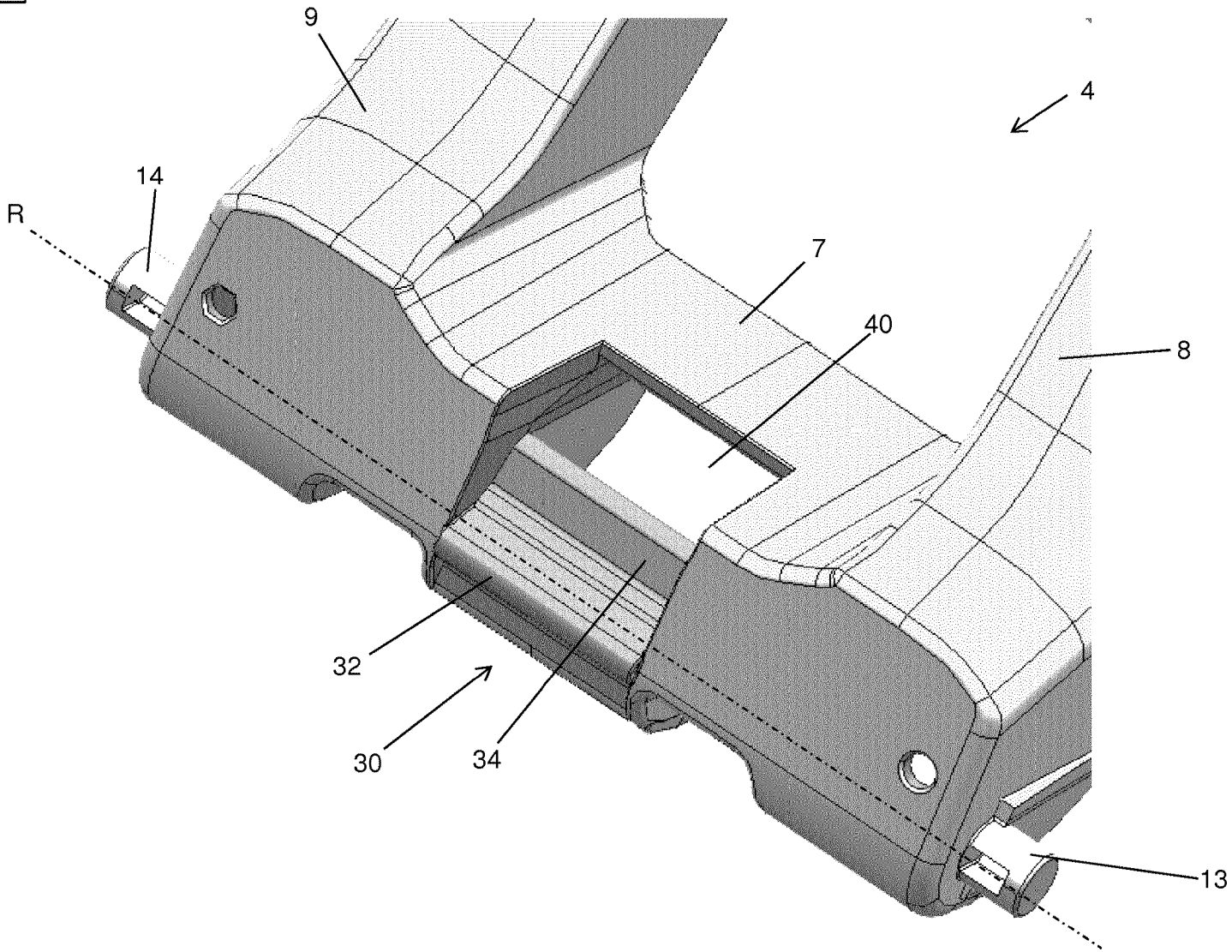
FIG. 8 shows a perspective detail view of the retaining bracket including a detent lug.
Figure 9:
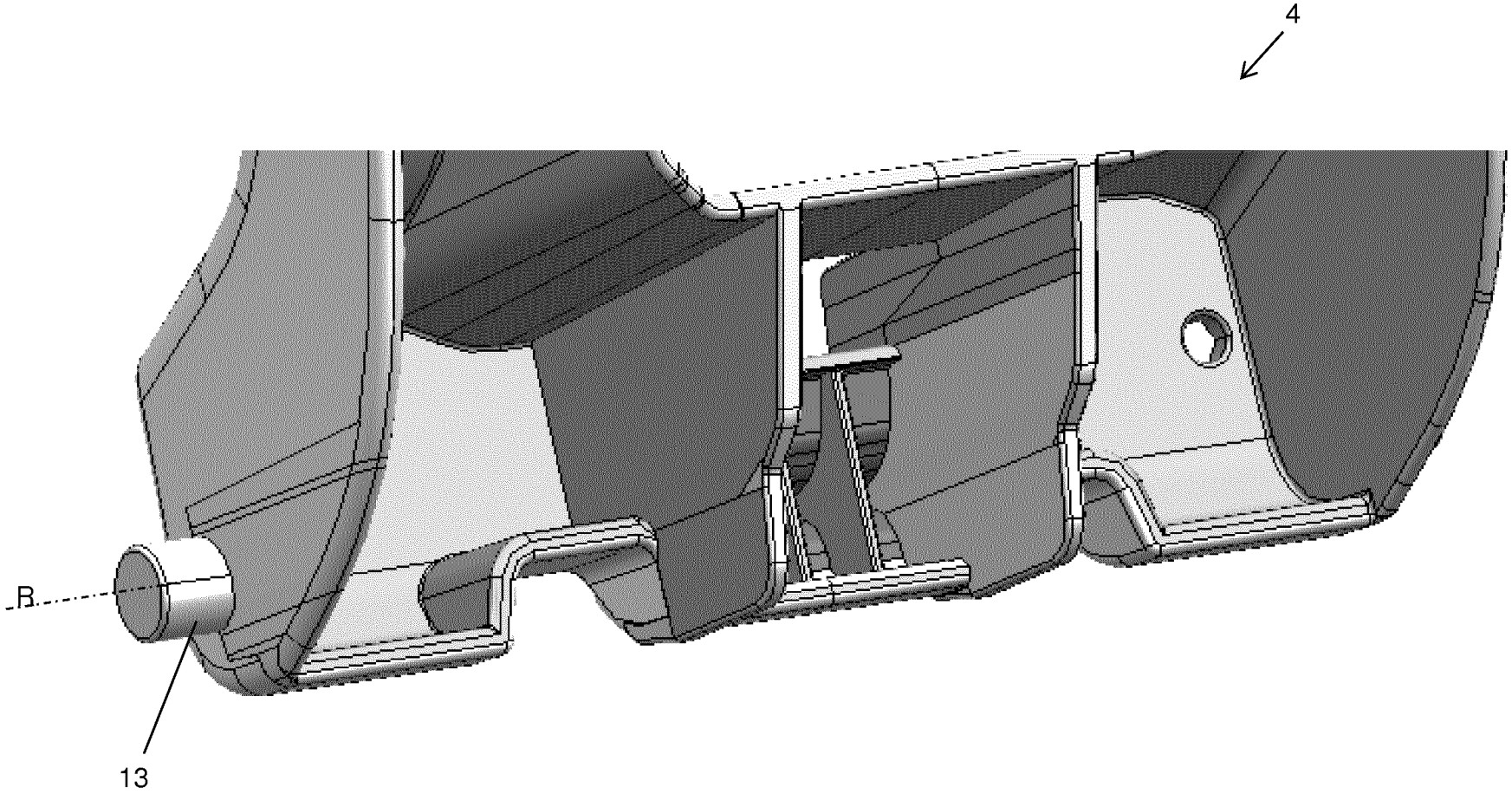
FIG. 9 shows a rear view of the retaining bracket.

As shown in FIG. 7 in particular, retaining bracket 4 includes a base element 7, a first prong element 8, and a second prong element 9. First and second prong elements 8, 9 are situated in parallel to one another and perpendicular to base element 7. Both first and second prong elements 8, 9 each include a first and a second end 8*a*, 8*b*; 9*a*, 9*b*. As shown in FIGS. 8 and 9 in particular, particular first end 8*a*, 9*a* of first and second prong element 8, 9 is fastened on base element 7. As is apparent in FIG. 7, a connecting element 10 is located between first and second prong elements 8, 9. Connecting element 10 is positioned in a direction A approximately in the last third of the length of prong elements 8, 9 and is used to prevent the two prong elements 8, 9 from moving away from one another. However, it is also possible that connecting element 10 is positioned in the middle of prong elements 8, 9 or also at particular second end 8*b*, 9*b* of prong elements 8, 9. Connecting element 10 may also be referred to as a supporting or stabilizing element.

Retaining bracket 4 or the two prong elements 8, 9 of retaining bracket 4 are used for insertion into a recess 11 of container 2 designed as a case, whereby container 2 is retained by retaining bracket 4 and fastened on transport unit 3, which is designed as a water treatment device. Recess 11 of case 2 is provided on handle 12 of case 2 and is actually used so that a user may grasp handle 12 of case 2 with one hand.

In addition, retaining bracket 4 includes a first and second bearing pin 13, 14. First bearing pin 13 is positioned at first end 8*a* of first prong element 8. Second bearing pin 14 is positioned at first end 9*a* of second prong element 9. As shown in FIGS. 7 and 8, first and second bearing pins 8, 9 are each designed as cylindrical having a circular cross-sectional area. Both bearing pins 13, 14 extend horizontally or perpendicularly to the two prong elements 8, 9.

Figure 4:
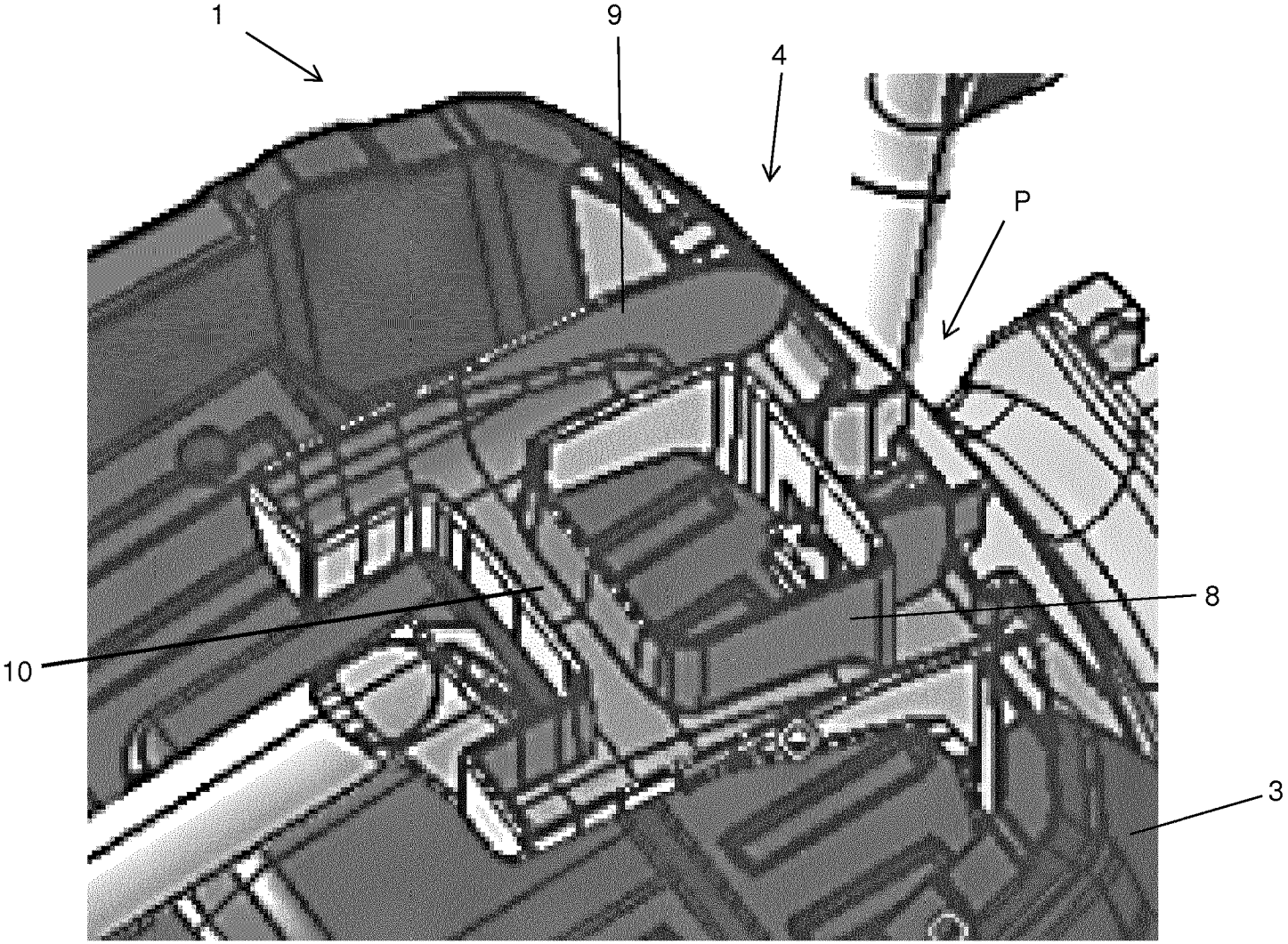
FIG. 4 shows a detail view of the device for retaining the container, a retaining bracket being located in the first plane.
Figure 5:
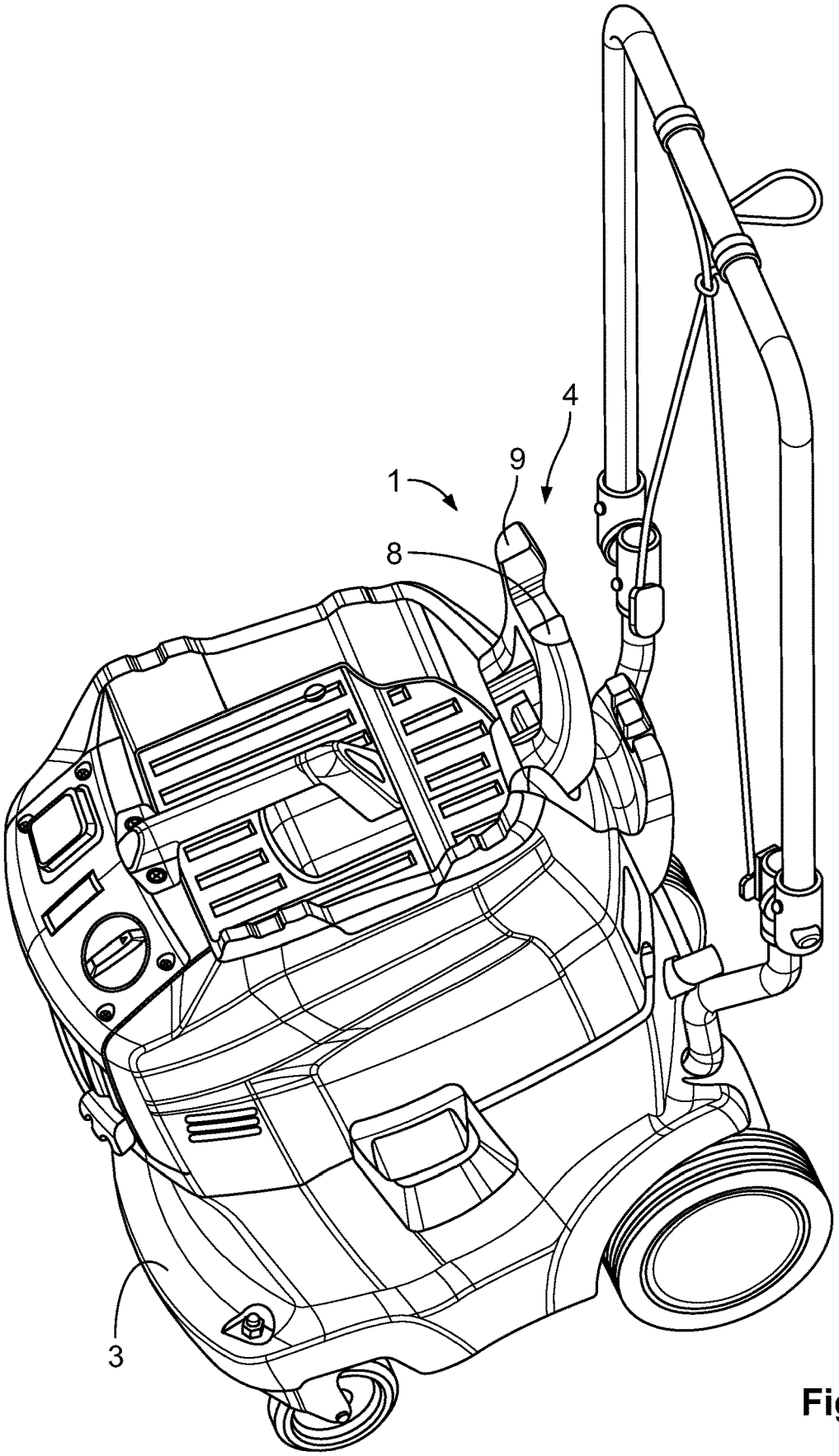
FIG. 5 shows a perspective view of the transport unit including the device according to the present invention for retaining the container, a retaining bracket being located in the second plane.
Figure 6:
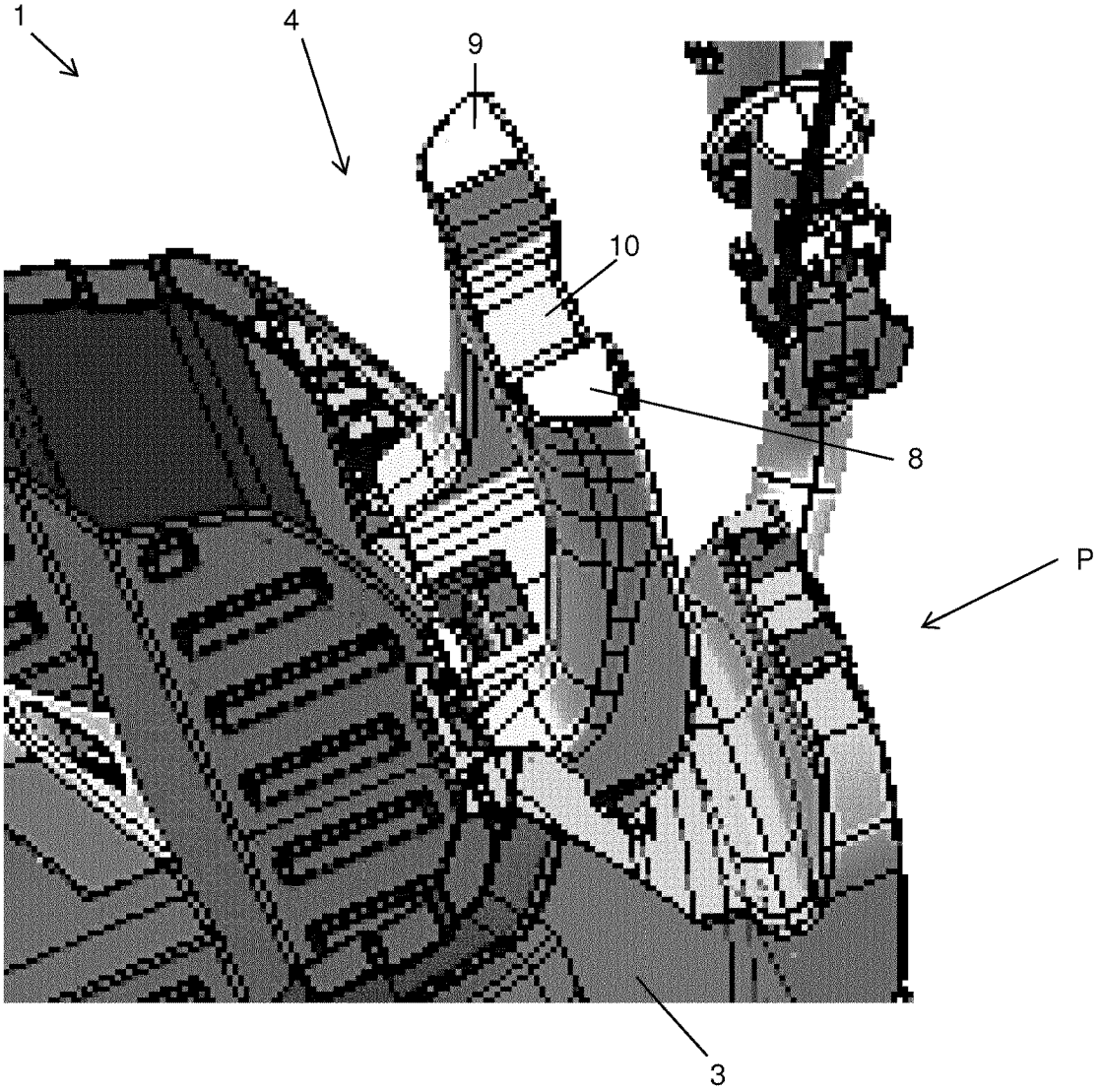
FIG. 6 shows a detail view of the device for retaining the container, a retaining bracket being located in the second plane.
Figure 10:
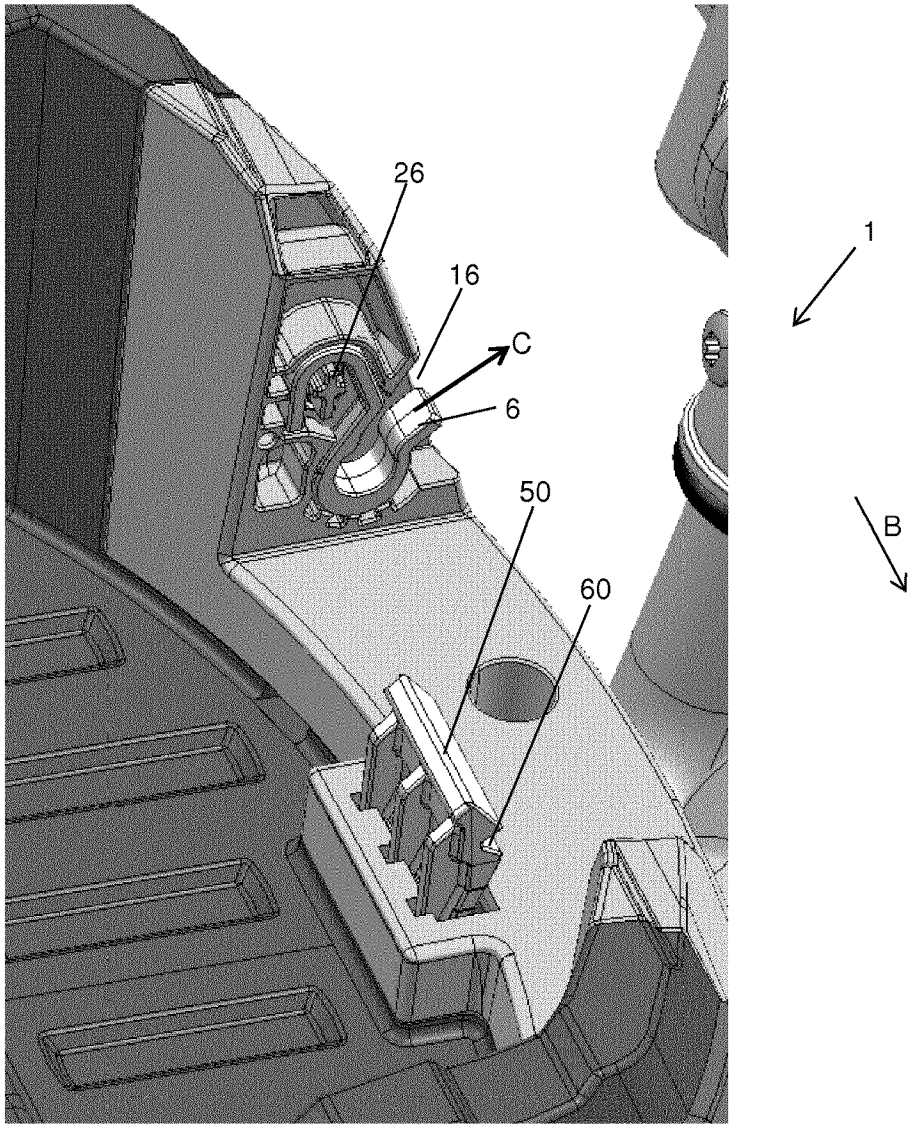
FIG. 10 shows a detail view of a bearing element and a positioning unit including a detent groove.
Figure 11:
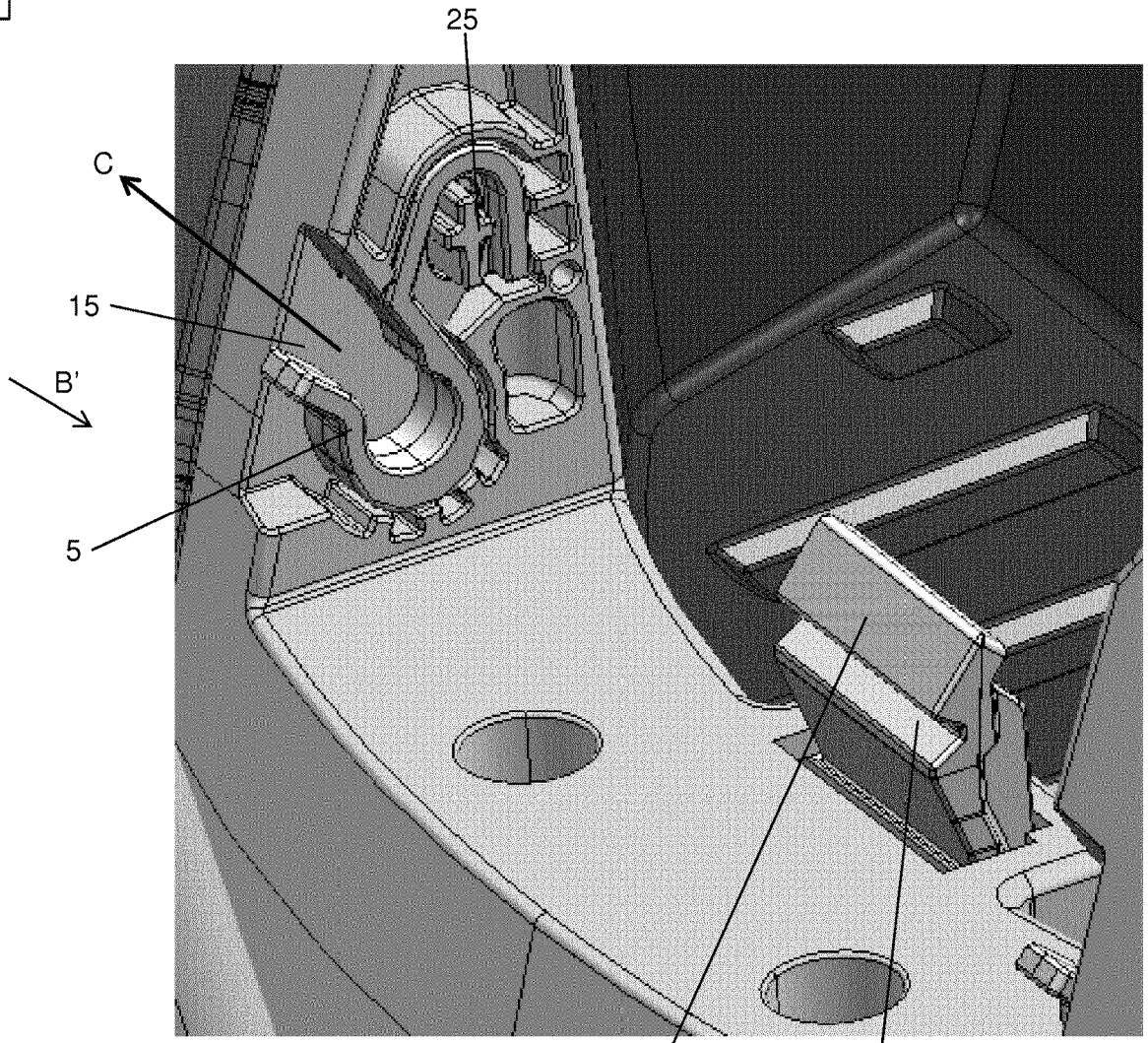
FIG. 11 shows a further detail view of the bearing element and the positioning unit including a detent groove.

As shown in FIGS. 10 and 11, first bearing element 5 is designed for accommodating and supporting first bearing pin 13 and second bearing element 6 is designed for accommodating and supporting second bearing pin 14. First and second bearing pins 13, 14 are rotatable in the particular bearing element 5, 6 around a shared axis R, so that entire retaining bracket 4 is reversibly positionable in a first and second plane. The first plane extends essentially horizontally and the second plane extends essentially vertically. In FIG. 4, retaining bracket 4 is shown in the first horizontal plane. FIGS. 1, 2, 3, and 5 show retaining bracket 4 in the second vertical plane.

When retaining bracket 4 is located in the first horizontal plane, retaining bracket 4 presses flatly against an upper surface of transport unit 3, which is designed as a water treatment device. In contrast, when retaining bracket 4 is located in the second vertical plane, retaining bracket 4 or the two prong elements 8, 9 protrude vertically from the upper surface of transport unit 3, which is designed as a water treatment device, so that retaining bracket 4 may be inserted into recess 11 of container 2, which is designed as a case.

Both first and second bearing element 5, 6 each include a recess 15, 16, so that first and second bearing pins 13, 14 may be removed from particular bearing element 5, 6 when retaining bracket 4 is in a removal position. As shown in FIGS. 10 and 11, first and second bearing elements 5, 6 have an S-shaped design. The lower arc of the S shape, which includes the recess, forms the actual receptacle or bearing for bearing pins 13, 14 in this case. The lower arc is designed to be elastic or flexible, so that a pressure on the lower arc does not directly result in damage to bearing elements 5, 6. Particular bearing element 5, 6 is positioned on transport unit 3, which is designed as a water treatment device, with the aid of the upper arc. The upper arc of first bearing element 5 encloses a first fastening element 25 and the upper arc of second bearing element 6 encloses a second fastening element 26. Both first and second fastening elements 25, 26 are designed as pins having a cross-shaped cross-sectional area. First bearing element 5 is removable from first fastening element 25 in a direction B and second bearing element 6 is removable from second fastening element 26 in a direction B'.

In addition, base element 7 of retaining bracket 4 includes a central receptacle element 30 and a recess 40 (cf. FIG. 8). Receptacle element 30 includes a protrusion 32 and a depression 34.

Furthermore, device 1 includes a resiliently supported retaining element 50, which is positioned on the upper surface of transport unit 3, which is designed as a water treatment device, and between first and second bearing elements 5, 6. Retaining element 50 is used for retaining or locking retaining bracket 4 in the first or second plane when retaining bracket 4 is positioned on transport unit 3, and includes a horizontally extending notch 60. In an assembled state, i.e., when bearing pins 13, 14 are positioned in bearing elements 5, 6, retaining element 50 rests against retaining bracket 4. When retaining bracket 4 is located in the first horizontal plane, the free end of receptacle element 30 presses against notch 60 of retaining element 50 and when retaining bracket 4 is in the second vertical plane, protrusion 32 of receptacle element 30 rests against notch 60 of retaining element 50. Depression 34 of receptacle element 30 and recess 40 are primarily used so that receptacle element 30 may be moved on or around retaining element 50.

The combination of receptacle element 30 and retaining element 50 may be referred to as a positioning unit P, since retaining bracket 4 may be positioned in the first or second plane with the aid of positioning unit P.

When retaining bracket 4 is positioned on transport unit 3, retaining bracket 4 may be reversibly moved from the first horizontal plane in a direction N into the second plane. As described above, bearing pins 13, 14 enable a rotation in bearing elements 5, 6. Retaining bracket 4 may be locked in the first or second plane with the aid of receptacle element 30 and retaining element 50. Resiliently supported retaining element 50 allows the disengagement of receptacle element 30 from the lock.

Retaining bracket 4 is located in the removal position when retaining bracket 4 is rotated from the second plane further in direction N. In the removal position, retaining bracket 4 may be removed from transport unit 3 or bearing pins 13, 14 in a direction C out of bearing elements 5, 6.

When retaining bracket 4 is pressed farther in direction N from the second plane, recesses 15, 16 of bearing elements 5, 6 and the elastic or flexible property of the lower arc of bearing element 5, 6 enable bearing pins 13, 14 to move out of bearing elements 5, 6, without bearing elements 5, 6 and in particular the lower arc of bearing elements 5, 6 being damaged by retaining bracket 4.

What is claimed is:

1. A transport combination comprising:

a transport unit;

a container; and a device for retaining the container on the transport unit, the device comprising:

a retaining bracket for insertion into a recess of the container, the container being retained by the retaining bracket and fastened on the transport unit, the retaining bracket including a first bearing pin and a second bearing pin; and a first bearing element for accommodating the first bearing pin and a second bearing element for accommodating the second bearing pin, the first and second bearing pins being rotatable in the respective first or second bearing element around a shared axis;

the retaining bracket being positionable reversibly in a first and second plane and the first plane extending horizontally and the second plane extending vertically, and the retaining bracket being insertable into the recess of the container when the retaining bracket is located in the second plane, the first and second bearing elements each including a bearing element recess, so that the first and second bearing pins are removable from the respective first and second bearing elements when the retaining bracket is located in a removal position.

2. The transport combination as recited in claim 1 wherein the first and second bearing elements each include an elastic component, a width of the recess on the first or second bearing element being changeable.

3. The transport combination as recited in claim 1 further comprising a positioning unit for securing the retaining bracket in the first or second plane.

4. The transport combination as recited in claim 3 wherein the positioning unit includes at least one notch and a protrusion corresponding to the notch.

5. The transport combination as recited in claim 1 wherein the container is a case.

6. The transport combination as recited in claim 1 wherein the retaining bracket includes a first prong and a second prong.

7. The transport combination as recited in claim 6 wherein the retaining element includes a base and first ends of the first and second prongs are fastened on the base.

8. The transport combination as recited in claim 6 further comprising a connector between the first and second prong to prevent the first and second prong from moving away from one another.

9. The transport combination as recited in claim 6 wherein the first and second prongs are designed for insertion into the recess of the container.

10. The transport combination as recited in claim 6 wherein the first and second bearing pins extend perpendicularly to the first and second prongs.

11. The transport combination as recited in claim 3 wherein the positioning unit includes a receptacle and a retaining element.

12. The transport combination as recited in claim 11 wherein a notch of the retaining element interacts with protrusion of the receptacle.

13. The transport combination as recited in claim 1 wherein the transport unit is a water treatment device.

14. The transport combination as recited in claim 1 wherein the container includes a handle, the recess of the container being provided on the handle.

15. A tool transport device comprising:

a transport unit;

a tool container; and a device for retaining the tool container on the transport unit, the device comprising:

a retaining bracket for insertion into a recess of the tool container, the tool container being retained by the retaining bracket and fastened on the transport unit, the retaining bracket including a first bearing pin and a second bearing pin; and a first bearing element for accommodating the first bearing pin and a second bearing element for accommodating the second bearing pin, the first and second bearing pins being rotatable in the respective first or second bearing element around a shared axis;

the retaining bracket being positionable reversibly in a first and second plane and the first plane extending horizontally and the second plane extending vertically, and the retaining bracket being insertable into the recess of the tool container when the retaining bracket is located in the second plane, the first and second bearing elements each including a bearing element recess, so that the first and second bearing pins are removable from the respective first and second bearing elements when the retaining bracket is located in a removal position.

16. The transport combination as recited in claim 15 wherein the transport unit is a water treatment device.

* * * * *